US007135638B2

(12) United States Patent
Garrett et al.

(10) Patent No.: US 7,135,638 B2
(45) Date of Patent: Nov. 14, 2006

(54) DYNAMIC MAGNETIC PICKUP FOR STRINGED INSTRUMENTS

(75) Inventors: Gary D. Garrett, Atascadero, CA (US); Lloyd R. Baggs, 483 N. Frontage Rd., Nipomo, CA (US) 93444

(73) Assignee: Lloyd R. Baggs, Nipomo, CA (US)

( * ) Notice: Subject to any disclaimer, the term of this patent is extended or adjusted under 35 U.S.C. 154(b) by 5 days.

(21) Appl. No.: 10/723,441

(22) Filed: Nov. 25, 2003

(65) Prior Publication Data

US 2005/0109197 A1 May 26, 2005

(51) Int. Cl.
*G10H 3/14* (2006.01)
*G10H 3/18* (2006.01)

(52) U.S. Cl. ..... 84/725; 84/726; 84/728

(58) Field of Classification Search ..... 84/723–732
See application file for complete search history.

(56) References Cited

U.S. PATENT DOCUMENTS 3,725,561 A * 4/1973 Paul ..... 84/726
4,501,186 A * 2/1985 Ikuma ..... 84/726
4,581,974 A * 4/1986 Fender ..... 84/725
4,581,975 A * 4/1986 Fender ..... 84/725
4,688,460 A * 8/1987 McCoy ..... 84/724
4,815,353 A * 3/1989 Christian ..... 84/724
5,012,086 A * 4/1991 Barnard ..... 250/222.1
5,027,691 A * 7/1991 Kennedy ..... 84/727
5,168,117 A * 12/1992 Anderson ..... 84/726

* cited by examiner

*Primary Examiner*—Lincoln Donovan
*Assistant Examiner*—David S. Warren
(74) *Attorney, Agent, or Firm*—Christie, Parker & Hale, LLP

(57) ABSTRACT

A pickup for use in a stringed musical instrument. The pickup includes a primary transducer that is sensitive to the motion of the musical instrument's strings and is mechanically coupled to the body of the musical instrument. The primary transducer senses the motion of the musical instrument's strings and generates a "string sound" signal in response. The primary transducer is further flexibly coupled to a secondary transducer that is not fixedly attached to the body of the musical instrument. Relative motion between the primary transducer and the secondary transducer generates a "body sound" signal within the secondary transducer. The string sound signal and the body sound signal are combined to generate a signal representing the acoustical response of the musical instrument.

16 Claims, 6 Drawing Sheets

DYNAMIC MAGNETIC PICKUP FOR STRINGED INSTRUMENTS

BACKGROUND OF THE INVENTION

The present invention pertains generally to the amplification of steel-stringed musical instruments and more specifically to amplification of steel-stringed musical instruments using transducers sensitive to both body and string sounds.

The use of string-sensitive magnetic pickups to amplify stringed musical instruments is well known. Magnetic pickups have a distinctive sound that is valued by many players. Magnetic pickups are primarily responsive to the motion of the metal string itself within the pickup's magnetic field, therein termed "string sound", and are only slightly responsive to mechanical vibrations of the musical instrument, herein termed "body sound". This is a limitation when trying to reproduce all the complexities of a musical instrument, and is especially limiting on an acoustic musical instrument, since the tonal character of an acoustic instrument is largely created by the mechanical amplification and resonances of the instrument's body.

String-sensitive magnetic pickups may have several disadvantages. A string-sensitive magnetic pickup is insensitive to the tonal character of a resonant body of an acoustic musical instrument. In addition, string-sensitive magnetic pickups are also relatively insensitive to incidental sounds that contribute greatly to the realism of the amplified sound, such as finger noise and the player's deliberate taps on the body of a musical instrument.

Body-sensitive pickups may suffer from several disadvantages. For example, when an acoustic musical instrument is amplified, a feedback loop may be created that includes the amplifier, the speakers, the musical instrument's body, and the body pickup. Such a system will tend to oscillate uncontrollably at the resonant frequencies of the musical instrument's body, making the musical instrument unusable above a certain volume level. When a body-sensitive pickup is amplified enough to be heard along with other amplified instruments, such feedback is very likely and becomes a real problem. In addition, a body-sensitive pickup may only pick up certain frequencies from the part of the body to which it is attached, and thus will not have the full sound of the musical instrument. Specifically, body-sensitive pickups tend to have an excess of midrange response, a lack of response to the fundamental (lowest) frequencies of the musical instrument's string vibration, a more "distant" sound because it takes a certain amount of time for the body to respond to the strings, and a lack of immediate response (attack) when the player strikes the string. Finally, body-sensitive pickups tend to reproduce too much incidental noise, emphasizing taps and finger squeaks more than is needed for realistic reproduction.

Attempts to add body sound to magnetic pickups have been made, by mixing body-sensitive pickups such as microphones or piezoelectric transducers with the sound of the magnetic pickup. For example, U.S. Pat. No. 4,501,186 issued to Ikuma describes a mixing system that combines a magnetic pickup in a soundhole of an acoustic musical instrument with a piezoelectric transducer attached to the body of the musical instrument. This approach requires separate string-sensitive and body-sensitive transducers, electronic amplification and mixing, and extra power supplies such as batteries in the musical instrument or pickup, each of which adds cost, complexity and inconvenience. Such systems also contribute noise to the signal.

Another attempt to add body sound to string sound is described in U.S. Pat. No. 3,725,561 issued to Paul. Paul describes a magnetic pickup with a ferromagnetic mass suspended in an elastomeric material below the coil. The coil is attached to the musical instrument's body. The mass remains relatively stationary because of its inertia, and the coil moves relative to the mass. This induces a small amount of signal in the coil that is responsive to body vibration. However, this method reproduces primarily the lower frequencies of the body vibration. The amount of body-vibration signal it contributes to the total pickup sound is subtle and difficult to hear.

SUMMARY OF THE INVENTION

A pickup for use in a stringed musical instrument. The pickup includes a primary transducer that is sensitive to the motion of the musical instrument's strings and is mechanically coupled to the body of the musical instrument. The primary transducer senses the motion of the musical instrument's strings and generates a "string sound" signal in response. The primary transducer is further flexibly coupled to a secondary transducer that is not fixedly attached to the body of the musical instrument. Relative motion between the primary transducer and the secondary transducer generates a "body sound" signal within the secondary transducer. The string sound signal and the body sound signal are combined to generate a signal representing the acoustical response of the musical instrument.

In one aspect of the invention, a secondary noise canceling "hum bucking" coil is compliantly suspended near or under a primary coil and within a magnetic field generated by pole magnets associated with the primary coil. As such that the secondary coil acts as the inertial mass of an accelerometer. The primary coil of the pickup is rigidly mounted to the stringed instrument's body. As the body vibrates, so does the primary coil and its associated pole magnets. The compliantly suspended secondary coil, through inertia, resists transmission of the body vibrations from the primary coil. Therefore, the primary coil and secondary coil move relative to each other. As the secondary coil moves relative to the primary coil, the secondary coil's windings break magnetic flux lines created by the first coil's associated pole magnets, thus generating a current in the secondary coil. The generated current is thus representative of the vibrations of the stringed instrument's body and not the stringed instrument's strings. The output of the secondary coil is added to the output generated by the primary coil in order to introduce a "body" sound to the primary coil's "string" sound.

In another aspect of the invention, a pickup for a stringed musical instrument includes a primary coil magnetically coupled to a string of the musical instrument and fixedly attached to a string support structure. A secondary coil is magnetically coupled to the primary coil and also coupled to the primary coil by a flexible suspension mechanism.

In another aspect of the invention, the primary coil and the secondary coil are electrically coupled in a noise-cancellation or "hum bucking" circuit.

In another aspect of the invention, the primary coil further includes a primary coil winding wound in the same direction as a secondary coil winding in the secondary coil.

In another aspect of the invention, the string support structure includes a soundboard and the primary coil is fixedly attached to the soundboard.

In another aspect of the invention, the soundboard includes a soundhole and the pickup is mounted in the soundhole with the secondary coil extending into the musical instrument string support structure.

In another aspect of the invention, the pickup of claim the string support structure includes a recess and the primary coil is fixedly mounted to a surface of the string support structure with the secondary coil extending into the recess.

In another aspect of the invention, the secondary coil has a mechanical resonant frequency in the range from 100 Hz to 500 Hz.

In another aspect of the invention, the flexible suspension mechanism has spring constant in the range from $1\times10^4$ N/m to $1\times10^6$ N/m and the secondary coil has a mass in the range from 15 grams to 25 grams.

In another aspect of the invention, a pickup for a stringed musical instrument includes a primary coil having a magnetic field for generation of a string signal in response to string movement. A secondary coil is electrically coupled to the primary coil in a noise cancellation circuit and further flexibly coupled to a string support structure of the musical instrument and in the magnetic field of the primary coil. In this arrangement, the secondary coil generates a string support structure signal in response to string support structure vibrations.

In another aspect of the invention, a pickup for a stringed musical instrument having a string support structure, includes a primary coil. The primary coil has magnetic means for generation of a magnetic field in proximity to the string and the primary coil generates a string signal in response to movement of the string within the magnetic field. A secondary coil, electrically coupled to the primary coil in a noise-cancellation circuit, is suspended within the primary coil's magnetic field by suspension means. When the secondary coil vibrates within the magnetic field in response to movement of the string support structure, it generates a string support structure signal in response to vibrations of the string support structure.

In another aspect of the invention, the suspension means is a pillar mechanically coupling the primary coil with the secondary coil.

In another aspect of the invention, the pillar is substantially centered with respect to the secondary coil.

In another aspect of the invention, the string support structure includes a recess and the primary coil is fixedly mounted to a surface of the string support structure with the secondary coil extending into the recess.

In another aspect of the invention, a pickup for a stringed musical instrument having a string support structure includes a first coil magnetically coupled to a string of the musical instrument and fixedly attached to the string support structure. A second coil is electrically coupled in a noise-cancellation configuration with the first coil and fixedly attached to the string support structure. A third coil is magnetically coupled to the first coil flexibly coupled to the first coil by a suspension mechanism. A fourth coil is then mechanically coupled to the third coil and electrically coupled to the third coil in a noise-cancellation circuit.

In another aspect of the invention, the first coil further includes a first coil winding wound in the same direction as a second coil winding in the second coil.

In another aspect of the invention, the third coil further includes a third coil winding wound in the same direction as a fourth coil winding in the fourth coil.

In another aspect of the invention, wherein the string support structure includes a soundboard and the first coil is fixedly attached to the soundboard.

In another aspect of the invention the soundboard includes a soundhole and the pickup is mounted in the soundhole with the third coil and fourth coil extending through the soundhole and into the string support structure.

In another aspect of the invention, the string support structure includes a recess and the first coil is fixedly mounted to a surface of the musical instrument string support structure with the third coil and fourth coil extending into the recess.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1A:
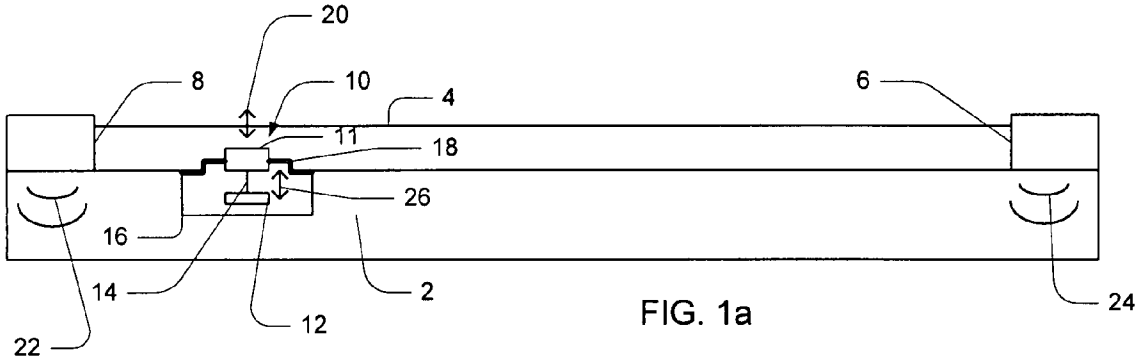
FIG. 1*a* is a block diagram of a stringed musical instrument and a dynamic magnetic pickup in accordance with an exemplary embodiment of the present invention.

FIG 1*a* is a conceptual diagram of a stringed musical instrument and dynamic magnetic pickup in accordance with an exemplary embodiment of the present invention. A stringed musical instrument includes a string support structure 2. The string support structure includes a first string attachment mechanism 6 and a second string attachment mechanism 8. A string 4 is fixedly attached at a first end to the first string attachment mechanism and at a second end at the second string attachment mechanism. The string is mounted in a spaced apart relationship to the string support structure such that the string is free to vibrate when it is set in motion such as by plucking or bowing.

A dynamic magnetic pickup 10 includes a primary coil 11 and a secondary coil 12 coupled together by a flexible structure 14. The dynamic magnetic pickup is mounted in recess 16 of the string support structure by a rigid mounting device 18.

Figure 1B:
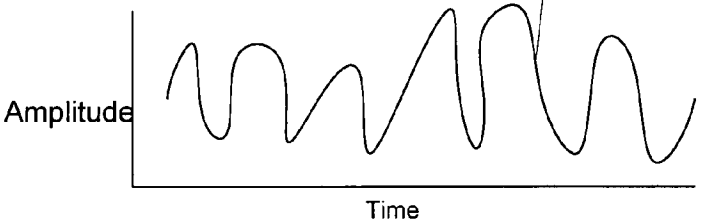
FIGS. 1*b*, 1*c*, and 1*d* illustrate combining string support structure signals and string signals in accordance with an exemplary embodiment of the present invention.

In operation, the primary coil includes magnets that generate a static magnetic field along a pole piece that is encased within wound wire coil. The primary coil is placed such that a string passes through the magnetic field. If the string is composed of a ferromagnetic material, vibration 20 of the string within the magnetic field will generate an electrical string signal within the wound wire coil. Therefore, in response to the string's vibration, the primary coil generates a string signal 28 of FIG. 1*b*.

Figure 1C:
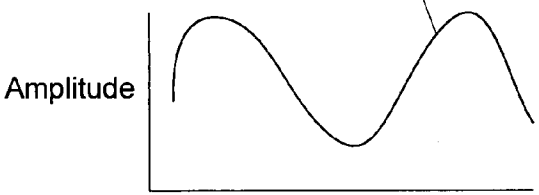
Figure 1D:
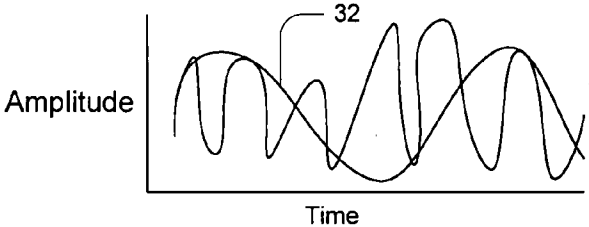

As the string vibrates, some of its vibrational energy, as denoted by vibrations 22 and 24, is transmitted into the string support structure through the first and second string attachment mechanisms. This energy causes the string support structure to vibrate in response. As the string support structure vibrates, the primary coil of the dynamic magnetic pickup vibrates, as indicated by arrow 26, as well because the primary coil is rigidly attached to the string support structure. However, as the secondary coil's is flexibly coupled to the primary coil, the secondary coil's inertia prevents the secondary coil from moving in unison with the primary coil, thus creating a relative motion between the primary and secondary coil. The relative motion between the primary and secondary coil generates a string structure signal, as represented by signal 30 of FIG. 1*c*, in the secondary coil. As the primary coil and secondary coil are conductively electrically coupled, the string signal and the string support structure signal are combined into an output signal 32 of FIG. 1*d*.

Figure 1E:
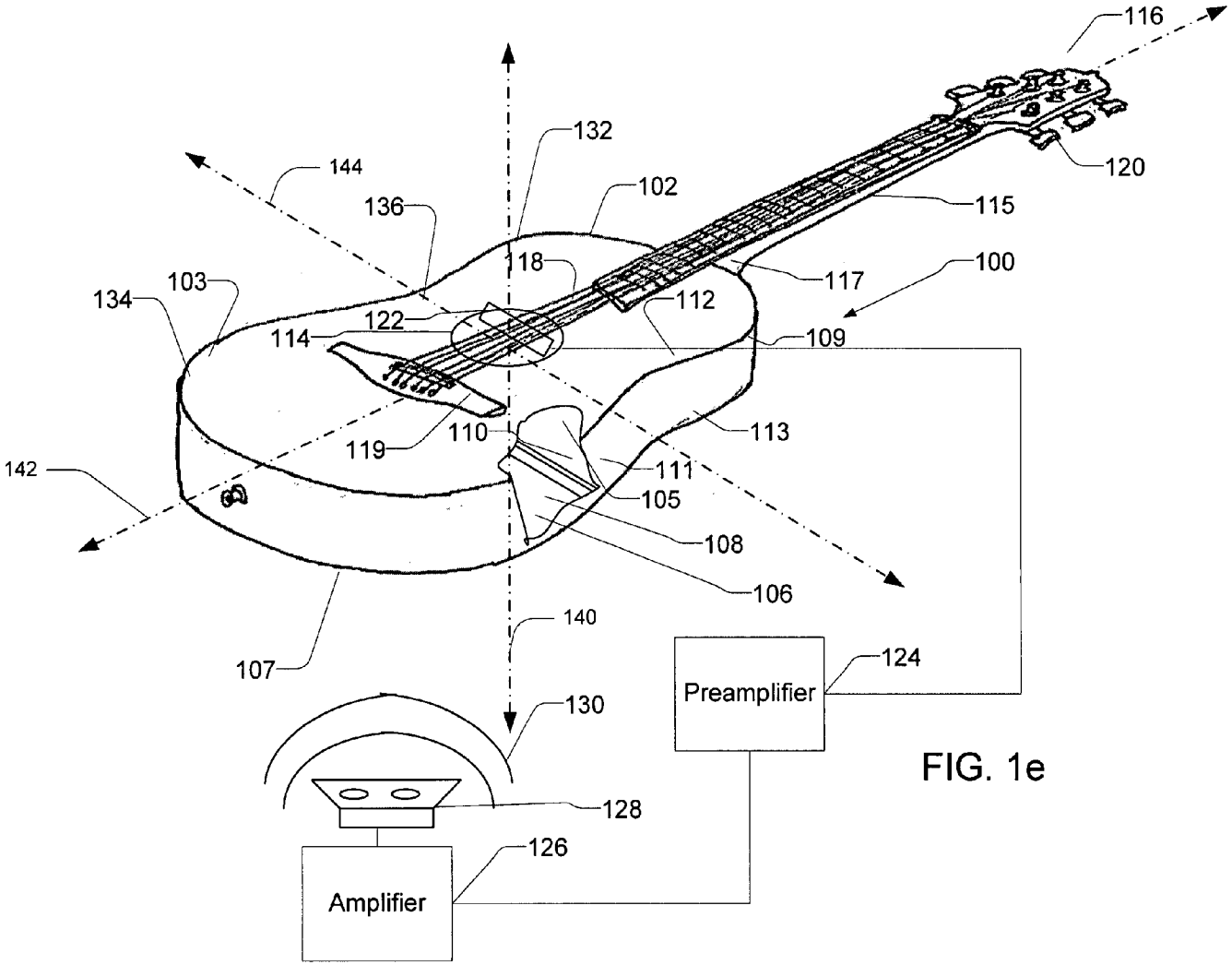
FIG. 1*e* is a perspective drawing of a musical instrument with a dynamic magnetic pickup in accordance with an exemplary embodiment of the present invention.

FIG. 1*e* is a perspective drawing of a musical instrument with a dynamic magnetic pickup in accordance with an exemplary embodiment of the present invention. A musical instrument 100, such as a guitar, includes a string support structure or body 102. The body has a sound board or top portion 103. The top portion has an outer surface 104 and an inner surface 105. A sound hole 114 is located in sound board and extends from the sound board's outer surface to the sound board's inner surface. The body also includes a back portion 106. The back portion includes an outer surface 107 and an inner surface 108. The body also includes a side portion 109 having an inner surface 110 and an outer surface 111. As illustrated in the perspective drawing, the top portion and the back portion are substantially parallel to each other. The side portion extends from peripheral edge 112 of the top portion to a peripheral edge 113 of the bottom portion coupling and separating the top portion and the back portions to create an enclosed body for the musical instrument.

The musical instrument further includes a neck 115 having a head 116 at a first end and a heel 117 at a second end. The neck is fixedly coupled to the perforated body by the heel. One or more strings 118 are each removably coupled to the outer surface of the top portion of the perforated body by a saddle and bridge assembly 119 at a first end portion of each string. Each string is also removably coupled to the head by winding a second end portion of each string around a tuning peg 120 located on the head. The tension of the each string is adjusted using the tuning peg so that plucking a string causes the string to vibrate. As the string vibrates, vibrational energy from the string is transferred to the top portion of the body causing the top portion to vibrate in unison with the plucked string.

As both the strings and the top portion of the guitar vibrate, there are at least two sources of vibrational energy available from the musical instrument for transduction into electrical signals. Both forms of vibrational energy are sensed by a dynamic magnetic pickup 122. The dynamic magnetic pickup is mechanically coupled to the body of the musical instrument and electromagnetically coupled to the vibrating strings. The pickup transduces the mechanical vibrations of the body and the strings into electrical signals that are then transmitted to a preamplifier 124. The preamplifier receives the electrical signals and generates amplified electrical signals which are transmitted to an audio amplifier 126. The audio amplifier further amplifies the electrical signals to generate electrical signals that are used to drive a loudspeaker 128 thus generating an amplified signal 130. As the dynamic magnetic pickup transduces both body vibrations and string vibrations, the amplified signal is representative of the original vibrational energy of the body and of the strings of the musical instrument.

In a dynamic magnetic pickup in accordance with an embodiment of the present invention, the dynamic magnetic pickup is mounted within the soundhole of the musical instrument. In this embodiment, the dynamic magnetic pickup is mechanically coupled to the sound board. In other embodiments, the dynamic magnetic pickup is mounted within the body of the musical instrument.

In other musical instruments with dynamic magnetic pickups in accordance with an exemplary embodiment of the present invention, the musical instrument does not have a hollow body. Instead, the musical instrument has a solid body without any interior cavities or has a semi-hollow body with a recess having a very small volume. These types of musical instruments have a reduced amount of body vibration. In this embodiment, the dynamic magnetic pickup is mounted between the strings and the body of the musical instrument in a body recess. The dynamic magnetic pickup is then solidly coupled to the body in order to sense the reduced amount of body vibration.

As illustrated above, the musical instrument's body has a first bout 132 and a second bout 134 with a waist portion 136 therebetween. In other musical instruments in accordance with exemplary embodiments of the present invention, the bodies may include more than two bouts, and therefore more than one waist, or may have only one bout, and therefore have no waist.

As illustrated above, a musical instrument with a dynamic magnetic pickup is used in conjunction with a preamplifier and an amplifier. While the preamplifier is not essential for amplification of the electrical signals produced by the dynamic magnetic pickup, the preamplifier may provide additional features through the use of filtering circuits included in the preamplifier.

The following descriptions of various embodiments of the present invention make reference to three axes shown in FIG. 1 in relationship to the musical instrument. A Z axis 140 is defined as extending along a depth of the musical instrument body from the sound hole to the back of the body. A Y axis 142 is defined as being parallel to the musical instrument's strings. An X axis 144 is defined as being perpendicular to both the Y axis and the Z axis.

Figure 2:
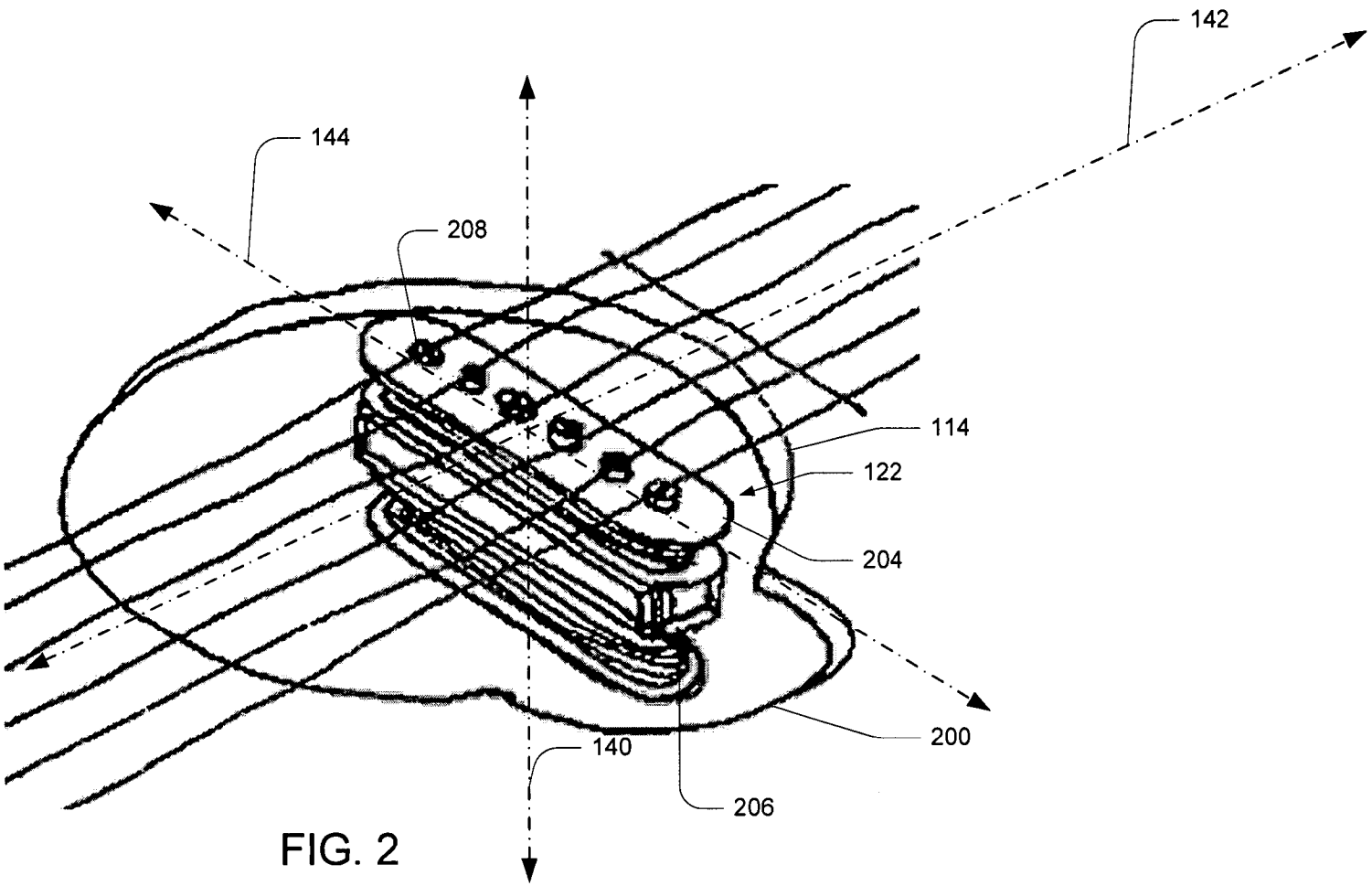
FIG. 2 is a perspective cutaway drawing of a dynamic magnetic pickup as installed in a musical instrument in accordance with an exemplary embodiment of the present invention.

FIG. 2 is a perspective cutaway drawing of a dynamic magnetic pickup as installed in a musical instrument in accordance with an exemplary embodiment of the present invention. A dynamic magnetic pickup 122 is shown installed in a soundhole 114 of a musical instrument. The soundhole includes a cutout 200 in order to show the structure of the dynamic magnetic pickup. The dynamic magnetic pickup is shown without its electrically grounded casing nor its mounting plate to further illustrate the structure of the dynamic magnetic pickup. The dynamic magnetic pickup includes a stacked magnetic pickup with a primary coil 204 and a secondary coil 206. The primary coil is elongated along the X axis 144 and is in proximity to the strings 118 of the musical instrument. The secondary coil is elongated along the X axis as well and is disposed parallel in a spaced apart relationship along the Z axis 140 with respect to the primary coil. The secondary coil is therefore further from the strings than the primary coil. The secondary coil is flexibly coupled to the primary coil.

Disposed within the primary coil are one or more primary ferromagnetic pole pieces 208, one below each string. These primary pole pieces are threadably coupled within the primary coil and have hex sockets at one end nearest the strings so the distance between the primary pole pieces and the strings may be adjusted along the Z axis. The primary pole pieces extend through the primary coil and one or more permanent magnets housed within a magnet housing 210 are placed in contact with the sides of the primary pole pieces.

Figure 3:
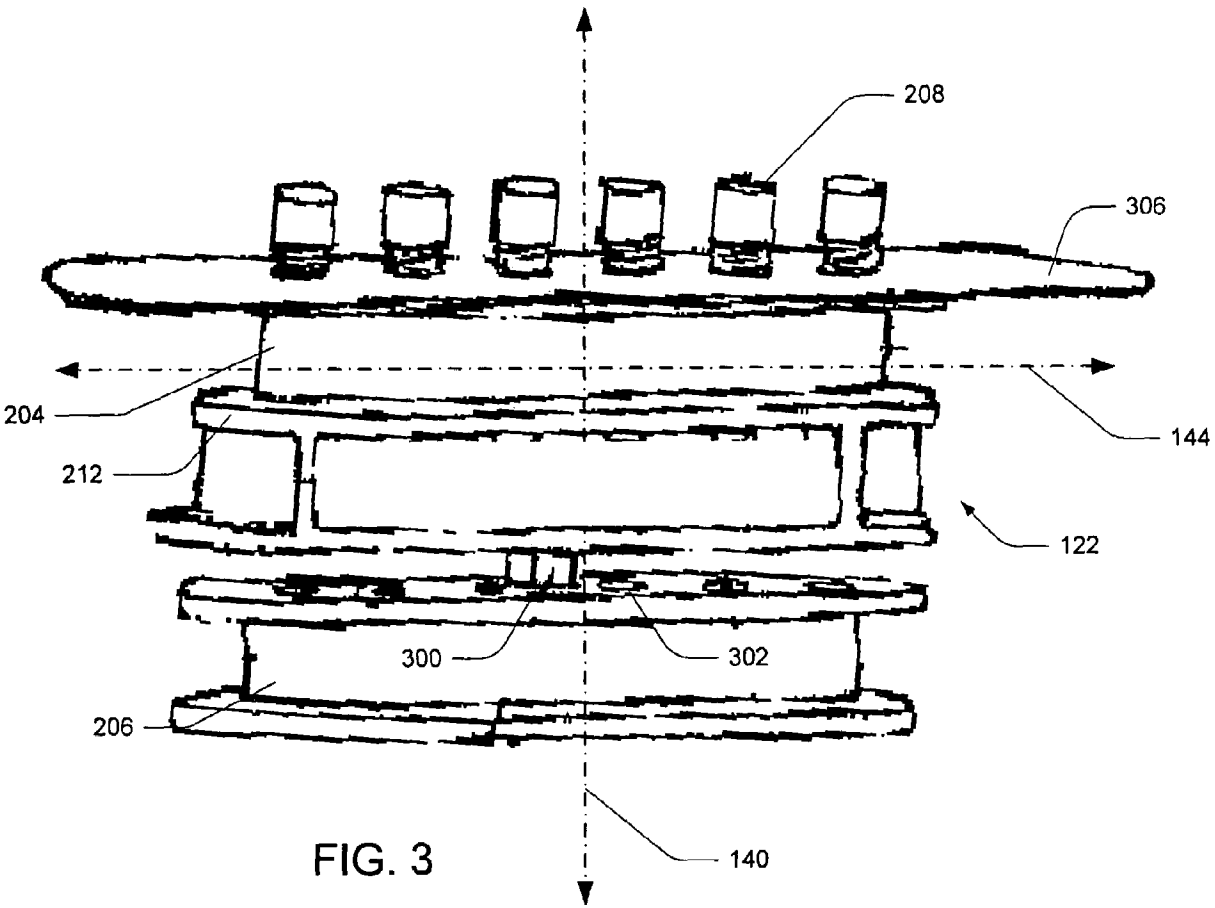
FIG. 3 is a perspective drawing of a dynamic stringed pickup in accordance with an exemplary embodiment of the present invention.

FIG. 3 is a perspective drawing of a dynamic stringed instrument pickup in accordance with an exemplary embodiment of the present invention. A dynamic magnetic pickup 122 is shown without its electrically grounded casing to further illustrate the structure of the dynamic magnetic pickup. The dynamic magnetic pickup includes a stacked magnetic pickup with a primary coil 204 and a secondary coil 206. The primary coil is elongated along the X axis 144. The primary coil includes a soundboard mounting plate 306 for solidly and mechanically coupling the dynamic magnetic pickup to the body of a musical instrument. The secondary coil is elongated along the X axis as well and is disposed parallel in a spaced apart relationship along the Z axis 140 with respect to the primary coil. The secondary coil is flexibly coupled to the primary coil by a suspension mechanism 300.

Disposed within the primary coil are one or more ferromagnetic primary pole pieces 208. These primary pole pieces are threadably coupled within the primary coil and have hex sockets at one end nearest the strings so the distance between the primary pole pieces and the strings may be adjusted along the Z axis. The primary pole pieces extend through the primary coil and one or more permanent magnets housed within a magnet housing 210 are placed in contact with the sides of the primary pole pieces.

The secondary coil includes one or more secondary ferromagnetic pole pieces 302 extending through the secondary coil along the Z axis. Each secondary pole piece is paired with, and aligned with, a corresponding primary pole piece disposed in the primary coil.

In operation, the instrument strings, vibrating in the magnetic field maintained by the one or more permanent magnets and primary ferromagnetic pole pieces, cause a current to flow in the primary coil which constitutes the string sound signal output. In addition, as the primary coil is fixedly attached to a soundboard of a musical instrument, vibrational energy is transmitted from the soundboard to the dynamic magnetic pickup. In response to the vibrational energy, the primary coil moves in synchronization with the soundboard.

However, the secondary coil is not rigidly coupled to the primary coil and thus the soundboard. Instead, the secondary coil is flexibly coupled to the primary coil by a the suspension mechanism. This allows the secondary coil, and the secondary pole pieces disposed within the secondary coile, to move relative to the permanent magnets housed by the magnet housing. This motion of the primary and secondary coils, relative to each other and to thus to the permanent magnets, induces an additional signal current in the secondary coil that is primarily responsive to the body sound of the musical instrument.

In a dynamic magnetic pickup in accordance with an exemplary embodiment of the present invention, the secondary coil is wound so as to be out of phase with the primary coil. Either the secondary coils turns can be wound in reverse to the primary coil, and the secondary coil's leads connected in the same manner (for example, both coils having an inner winding end connected to ground, and an outer winding end connected to a pickup output) or with the turns wound in the same direction and the leads connected in and opposite manner (for example, one coil has its inner winding connection to ground and the outer winding connected to the output, and the other coil has its inner winding connection to the output and the outer winding connected to ground). The coils may be connected in series or in parallel. In any of these configurations, electromagnetic interference sensed by one coil is canceled by the interference sensed by the other coil.

In another dynamic magnetic pickup in accordance with an exemplary embodiment of the present invention, a dynamic magnetic pickup uses a parallel wiring, with the coils wound in the same direction. The secondary coil may include any number of secondary pole pieces, or it may have fewer secondary pole pieces and more turns of wire than the primary coils so long as the inductance of the coils is equalized for optimal hum cancellation.

In contrast to string-sensitive magnetic pickups, various embodiments of the present invention add realism to a musical instrument's amplified signal by reproducing the nuances of the acoustic musical instrument, such as incidental noises, a sense of ambience and space, and the tone qualities of the musical instrument's resonant body. In contrast to body-sensitive pickups, the various embodiments of the present invention have the advantage of a string-sensitive pickup, such as responsiveness to the player (attack), widely desirable tone, and reproduction of the fundamental frequencies of the strings. Relative to body-sensitive pickups, susceptibility to feedback is greatly reduced by the use of a central pillar, which suppresses the motion of the instrument's body that is the largest cause of feedback. Relative to body-sensitive pickups, susceptibility to feedback is further reduced by mixing in a large proportion of the string sound, which is less feedback-prone.

In contrast to prior art mixing systems, the invention accomplishes these advantages in a single passive pickup, without the use of batteries or electronics, that can be plugged directly into a standard guitar amplifier or even a mixing board. Also in contrast to prior art mixing systems, the invention adds body sound without adding any additional elements, since the coil which is used for cancellation of electromagnetic interference is also used as the body pickup transducer, and a single magnetic means is used for both coils.

In contrast to the string/body pickup described in U.S. Pat. No. 3,725,561 issued to Paul, various embodiments of the present invention develop body-sensing signal in the secondary coil itself, which produces a much more dramatic response to the body sound, and combines noise immunity, full-range string sound and full-range body sound in a single design.

In the preferred embodiment, the bobbins upon which the coils are wound are molded as a unit in plastic, along with a pillar connecting the two. The pillar is substantially smaller than either of the coils, so that the secondary coil is relatively free to move and vibrate relative to the primary coil and magnets. The pillar is located roughly in the center of the secondary coil.

Figure 4:
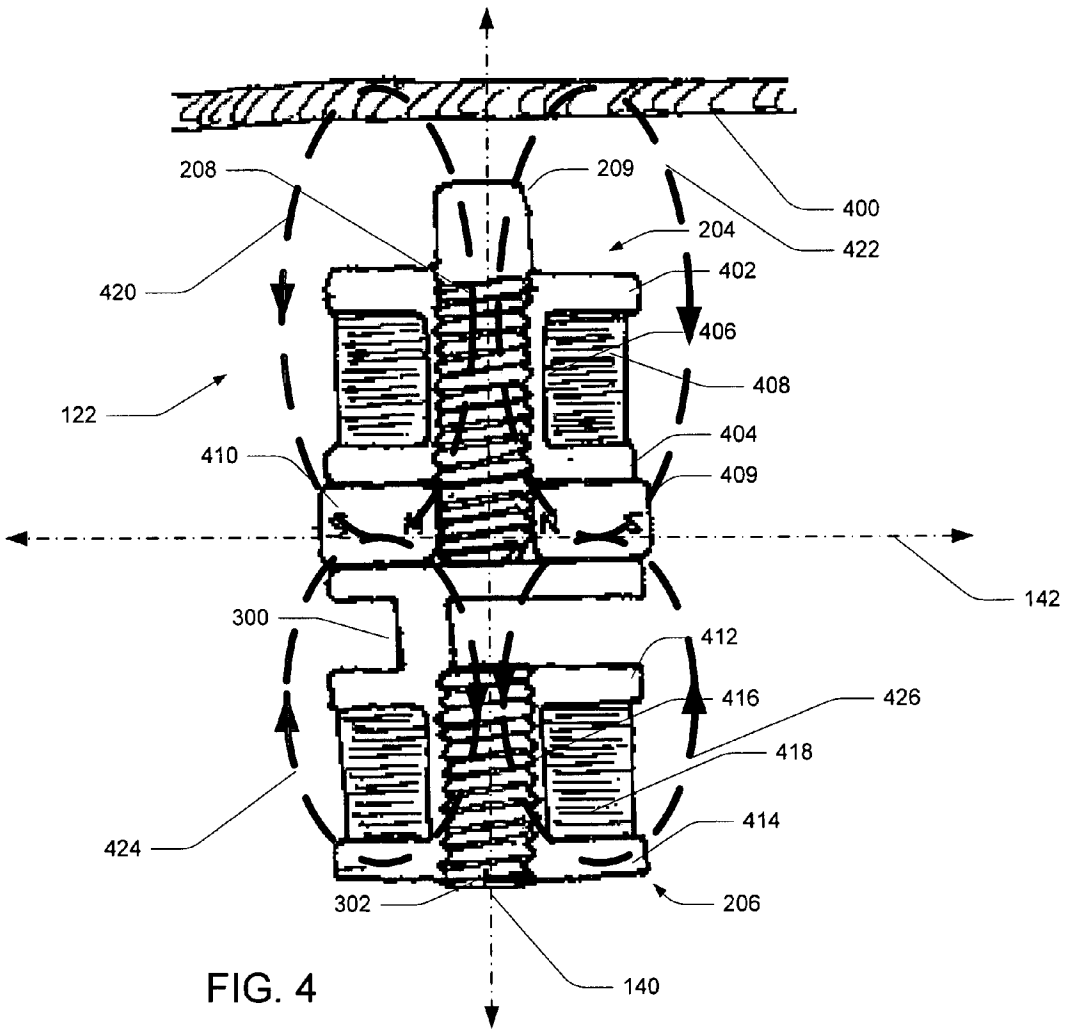
FIG. 4 is a cross-sectional view through a dynamic magnetic pickup in accordance with an exemplary embodiment of the present invention.

FIG. 4 is a cross-sectional view through a dynamic magnetic pickup in accordance with an exemplary embodiment of the present invention. A dynamic magnetic pickup 122 is shown in cross-section to further illustrate the structure of the dynamic magnetic pickup. The cross-section is taken along a plane parallel to a plane defined by the Y axis 142 and the Z axis 140. The dynamic magnetic pickup includes a stacked magnetic pickup with a primary coil 204 and a secondary coil 206. The secondary coil is in a spaced apart relationship along the Z axis 140 with respect to the primary coil. The secondary coil is flexibly coupled to the primary coil by a suspension mechanism 300.

Disposed within the primary coil are one or more ferromagnetic primary pole pieces 208. The primary pole piece is threadably coupled within the primary coil and includes a hex socket at one end 209 nearest a string 400 so that the distance between the primary pole piece and the string may be adjusted along the Z axis 140. The primary pole piece extends through the primary coil and into a magnet housing. The magnet housing houses one or more permanent magnets 409 and 410 that are placed in contact with the sides of the primary pole piece.

The primary coil includes a first flange 402 and a second flange 404 separated by a center portion 406 thus creating a bobbin through which the primary pole piece extends. A continuous length of insulated wiring 408 is wrapped around the center portion between the first and second flanges to create a primary wire coil having a plurality of turns. As such, the primary pole piece extends through the primary wire coil but is electrically insulated from the primary wire coil.

The secondary coil includes a first flange 412 and a second flange 414 separated by a center portion 416 thus creating a bobbin through which a secondary pole piece 302 extends. A continuous length of insulated wiring 408 is wrapped around the center portion between the first and second flanges to create a second wire coil having a plurality of turns. As such, the secondary pole piece extends through the secondary coil but is electrically insulated from the secondary wire coil. The secondary pole piece is paired with, and aligned with, the primary pole piece disposed in the primary coil.

The permanent magnets are placed such that they have a common pole coupled to the primary pole piece. In the illustrated embodiment, the North poles of the magnets are coupled to the primary pole piece. As such, the permanent magnets create a primary or string magnetic field, as illustrated by magnetic field flux lines 420 and 422, that are cut by the musical instrument string. In operation, the musical instrument string, vibrating in the string magnetic field, causes a current to flow in the primary coil by cutting through the magnetic flux lines. The signal induced in the primary coil by the vibrating musical string constitutes a string sound signal output by the dynamic magnetic pickup.

The permanent magnets also create a secondary magnetic field, as illustrated by magnetic field flux lines 424 and 426, that are cut by the secondary coil pole pieces. In operation, the secondary coil and pole pieces move in a relative motion to the primary coil as previously described. The movement of the secondary coil and pole pieces, vibrating in the secondary magnetic field, causes a current to flow in the secondary coil by cutting through the magnetic flux lines. The signal induced in the secondary coil by the relative movement between the primary and secondary coils constitutes a body sound signal output by the dynamic magnetic pickup.

The location, flexibility, and damping characteristics of the suspension mechanism may be varied to alter the proportion and character of the body sound admitted into the dynamic magnetic pickup relative to the string sound. Since many acoustic musical instruments are susceptible to runaway feedback when amplified, it is desirable to design the suspension mechanism to suppress modes of motion that contribute most to this feedback. In one embodiment of the present invention, the suspension mechanism is a pillar connecting the two coils, with the pillar approximately centered. By suppressing the relative movement of the secondary coil as a unit perpendicular to the top portion of the musical instrument (along the Z axis) unwanted acoustic feedback is suppressed.

In one suspension mechanism in accordance with an exemplary embodiment of the present invention, the suspension mechanism is in the shape of a pillar. The pillar, being made of ABS plastic or similar material, has a modulus of elasticity of about 2.3 GPa, and approximate dimensions of 0.150 inches along the Y axis by 0.250 inches along the X axis by 0.125 inches along the Z axis. This results in a spring constant on the order of $1\times10^5$ N/m. With wire, bobbin and pole pieces, a typical secondary coil weighs 15 to 25 grams. With this weight of coil, a spring constant in the range of $1\times10^4$ to $1\times10^6$ N/m is useful.

This arrangement allows considerable vibratory movement of the secondary coil, relative to the primary coil, and at a low resonant frequency. Prior pickups may lock the coils together by at least a wall of ABS the same size as the coils. This creates a support typically 2.5 inches by 0.7 inches by 0.070 inches. Such a structure is many times as stiff as the pillar in the present invention. Virtually every prior pickup also has steel pole pieces passing through both coils. The net result is a spring constant roughly 200 times higher than that of the present invention, or $2\times10^7$ N/m.

The following is a comparison of a prior pickup to an embodiment of the present invention. In the comparison the body sound to string sound ratio and resonant frequency of the pickups were determined:

| | Body/String ratio | Resonance |
|---|---|---|
| Embodiment of present invention | −10 dB | 345 Hz |
| Prior pickup | −34 dB | 5000 Hz |

It may be seen from the test results, that the particular embodiment of the present invention displayed 24 dB (16 times) more relative body sound when compared to the prior pickup.

The resonant frequencies of a typical acoustic guitar are in the 100 Hz to 400 Hz range, so it can be seen that the embodiment of the present invention is more responsive to the natural resonances of the guitar. This results in a more natural, realistic reproduction of the acoustic guitar's sound.

In various other embodiments of the present invention, smaller pillars and heavier secondary coils have been used to raise the body-to-string ratio to 0 dB or even higher, and to lower the resonant frequency yet further. This is useful on musical instruments, such as semi-hollow body musical instruments, with less vibration than a typical acoustic guitar, that need a more body-responsive pickup.

In other embodiments of dynamic magnetic pickups in accordance with the present invention, stiffer pillar materials or larger pillars may be used to lower the body sound to string sound ratio on especially lively instruments.

In other embodiments of dynamic magnetic pickups in accordance with the present invention, coil springs and leaf springs, rather than plastic pillars, are used as support mechanisms. The spring constant of these types of support mechanisms is far lower than that of the ABS, giving an even higher body sound output, and lower resonant frequency. Such a dynamic magnetic pickup may be useful when there is less vibration available to detect from the instrument, such as on a solid body guitar.

In other embodiments of dynamic magnetic pickups in accordance with the present invention, it is also possible to damp the suspension mechanism with an elastomer, which alters the body sound in ways a pickup designer may find useful.

In other embodiments of dynamic magnetic pickups in accordance with the present invention, the size, location and shape of the suspension mechanism may also be varied by a pickup designer to emphasize the various modes of motion of a musical instrument's vibration. For example, a pillar with a rectangular cross section has been previously illustrated. The longer the dimension along the X axis of the pillar, the higher the spring constant will be along that axis. Thus a dynamic magnetic pickup will have a higher resonant frequency and lower output in response to instrument movement along the X axis. Y axis vibration may also be tuned in this way, giving the designer independent control of a dynamic magnetic pickup's relative response to X and Y vibration.

In one dynamic magnetic pickup in accordance with an exemplary embodiment of the present invention, the suspension mechanism is a pillar that is longitudinally centered along the X axis. This design suppresses the tendency of the secondary coil from to move in a unitary manner along the Z axis in relation to the primary coil. It is this unitary movement along the Z axis that has been found to be a major source of runaway feedback.

In one dynamic magnetic pickup in accordance with an exemplary embodiment of the present invention, the suspension mechanism is offset slightly off center along the Y axis toward the neck of the musical instrument. This adds a small amount of Z-axis and Y-axis sensitivity to the dynamic magnetic pickup. Other suspension mechanisms may be centered for maximum feedback immunity.

In other dynamic magnetic pickups in accordance with exemplary embodiments of the present invention, a designer may also vary the body sound by changing the strength of the permanent magnets, and the number of primary and secondary pole pieces and the number of windings in the secondary coil, as long as the impedance of the two coils remains substantially the same for optimal noise cancellation.

In one dynamic magnetic pickup in accordance with an exemplary embodiment of the present invention, the dynamic magnetic pickup assembly is held in a housing that has clamps for attachment to the soundhole of a musical instrument. The housing firmly holds the primary coil and magnets, while the secondary coil is left free to vibrate within the housing. The housing is sprayed with conductive shielding paint, to screen out electrostatic interference, which may not be cancelled by the noise canceling coils. The coils are terminated to an output jack, so that a cord may be attached to carry the signal to an amplifier. The housing is then clamped to the body of the instrument, with the top of the primary coil in proximity to the strings.

Various modifications may be made to the present invention without deviating from its spirit. For example, various arrangements of coils, permanent magnets, and primary and secondary pole pieces may be incorporated into a dynamic magnetic pickup in accordance with various methods of pickup construction. With regard to the coils, the primary and secondary coils may be of different sizes, shapes, and number of turns, as long as their impedance is approximately the same. The secondary coil may or may not contain pole pieces. A single bar or blade may replace the individual pole pieces in the primary or secondary coil. The number of pole pieces may be more than or fewer than the number of strings. The secondary coil may be placed beside the primary, in proximity to the strings, in a side-by-side noise cancellation style. The primary and secondary coils do not need to be physically attached to each other, but may be separately mounted, with the primary coil mounted under the strings and the secondary coil to a vibrating member of the musical instrument.

With regard to the suspension mechanism and bobbins, the suspension mechanism and bobbins may be made of any material, or may be made separately and joined in assembly. The suspension mechanism of the secondary coil may be made of metal springs, elastomers, or include multiple pillars. The pillar(s) need not be centered.

With regard to the permanent magnets, the permanent magnets may be disposed within the primary coil as individual cylindrical pole pieces or as a single bar, eliminating the pole pieces entirely from the primary coil. There may also be separate sets of magnets for primary and secondary coil.

Nor is the present invention restricted to acoustic guitar soundhole pickups. Various embodiments of the present invention may be mounted with good effect on electric guitars, and is especially suited to hollow body jazz guitars.

Nor is the present invention restricted to passive pickups. The output from the primary and secondary coils may be mixed passively and then amplified within the pickup, or amplified separately and then mixed in proportion.

Figure 5:
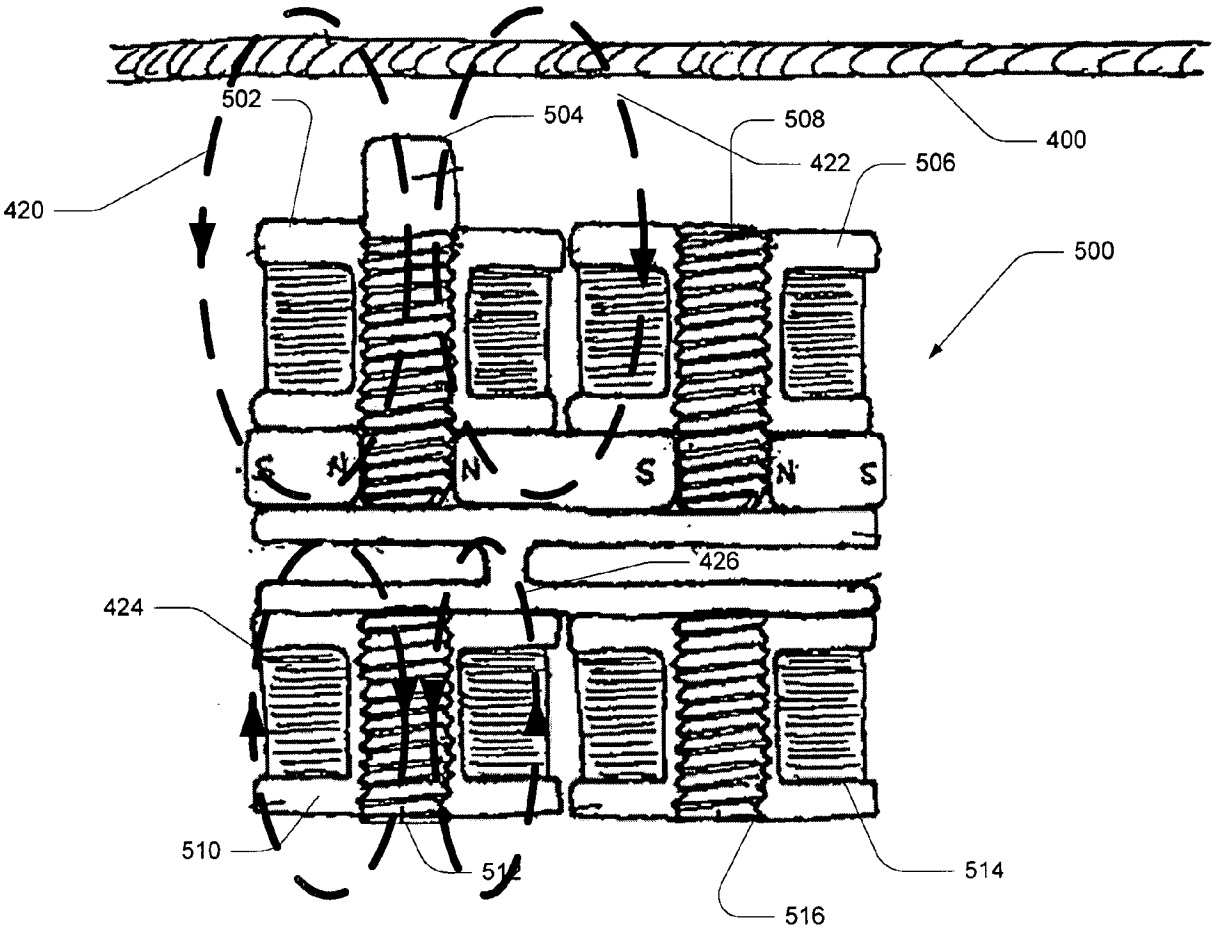

FIG. 5 is a semi schematic diagram of a four coil pickup in accordance with an exemplary embodiment of the present invention. In one embodiment of a dynamic magnetic pickup, the pickup may include four coils. A four coil dynamic magnetic pickup 500 includes a primary string sensitive coil 502 and corresponding pole piece 504 coupled to a first noise canceling coil 506 and corresponding pole piece 508. This pair of coils is wound in a noise canceling relationship and is disposed adjacent to a string 400 as with the primary coil in the above description. A secondary body sensitive coil 510 and its corresponding pole piece 512 are coupled to a second noise canceling coil 514 having a corresponding pole piece 516. The secondary coil and the second noise cancellation are suspended, free to vibrate, within a secondary magnetic field, to function as the secondary coil. The two coils may then be freely blended, actively or passively, in any proportion, without compromising the hum-canceling feature of the dynamic magnetic pickup.

Although this invention has been described in certain specific embodiments, many additional modifications and variations would be apparent to those skilled in the art. It is therefore to be understood that this invention may be practiced otherwise than as specifically described. Thus, the present embodiments of the invention should be considered in all respects as illustrative and not restrictive, the scope of the invention to be determined by any claims supported by this application and the claims' equivalents rather than the foregoing description.

What is claimed is:

1. A magnetic pickup for a stringed musical instrument, where the instrument includes strings suspended between a string support structure that includes a sound board, comprising:

a primary coil rigidly fixed to the sound board of the musical instrument;

at least one magnet rigidly fixed to the primary coil that generates a static magnetic field along at least one pole piece encased within the primary coil;

a secondary coil located spaced apart from the primary coil and flexibly suspended to move relative to the primary coil;

wherein the primary coil is configured to generate a signal that includes a string signal and does not include a body signal; and wherein the secondary coil is configured to generate a signal that includes a body signal and an attenuated string signal.

2. The pickup of claim 1, wherein the primary coil and the secondary coil are electrically coupled in a noise-cancellation circuit.

3. The pickup of claim 2, wherein the primary coil further comprises a primary coil winding wound in the same direction as a secondary coil winding in the secondary coil.

4. The pickup of claim 1, further comprising a clamping mechanism attached to the primary coil that enables the primary coil to be removably attached to the sound board.

5. The pickup of claim 1, wherein:

the soundboard includes a soundhole and the pickup is mounted in the soundhole;

the primary coil is positioned between the secondary coil and the strings.

6. The pickup of claim 1, wherein the soundboard includes a recess and the primary coil is fixedly mounted to a surface of the soundboard with the secondary coil extending into the recess.

7. The pickup of claim 1, wherein the secondary coil has a resonant frequency in the range from 100 Hz to 500 Hz.

8. The pickup of claim 1, wherein the flexible suspension mechanism has spring constant in the range from $1\times10^4$ N/m to $1\times10^6$ N/m.

9. The pickup of claim 8, wherein the secondary coil has a mass in the range from 15 grams to 25 grams.

10. A magnetic pickup for a stringed musical instrument, where the instrument includes strings suspended between a string support structure that includes a sound board, comprising:

a primary coil rigidly fixed to the sound board;

at least one magnet rigidly fixed to the primary coil that generates a static magnetic field along at least one pole piece encased within the primary coil;

a secondary coil suspended below the primary coil via a flexible suspension mechanism;

wherein the suspension mechanism suppresses relative movement of the secondary coil as a unit perpendicular to the top portion of the musical instrument.

11. The magnetic pickup of claim 10, wherein:

the suspension mechanism is a pillar;

the centerline of the primary coil defines a Z axis;

the primary coil is elongated in a direction that defines an X axis, which intersects the Z axis and is perpendicular to the Z axis;

the pillar is attached to the primary coil at a point that is centered with respect to the X axis; and the pillar is attached to the secondary coil at a point that is centered with respect to the X axis.

12. The magnetic pickup of claim 11, wherein:

a Y axis is defined in a direction that is perpendicular to the X axis and the Z axis;

the pillar is attached to the primary coil at a point on the Y axis offset from the intersection of the X axis and the Z axis; and the pillar is attached to the secondary coil at a point similarly offset along the Y axis.

13. The magnetic pickup of claim 10, wherein the secondary coil has a resonant frequency in the range from 100 Hz to 500 Hz.

14. The magnetic pickup of claim 10, wherein the suspension mechanism has spring constant in the range from $1\times10^4$ N/m to $1\times10^6$ N/m.

15. The magnetic pickup of claim 10, wherein the secondary coil has a mass in the range from 15 grams to 25 grams.

16. The magnetic pickup of claim 10, wherein the suspension mechanism is a pillar constructed from ABS plastic.

* * * * *